United States Patent [19]

Martin, Jr. et al.

[11] Patent Number: 4,711,259

[45] Date of Patent: Dec. 8, 1987

[54] MILK TANK CLEANING APPARATUS AND METHOD

[75] Inventors: Timothy J. Martin, Jr., Lynden; Richard T. Henry, Bellingham, both of Wash.

[73] Assignee: Light Industrial Design Company, Lynden, Wash.

[21] Appl. No.: 678,268

[22] Filed: Dec. 5, 1984

[51] Int. Cl.[4] ..... B08B 3/02

[52] U.S. Cl. ..... 134/166 R; 134/183; 239/550; 239/553; 239/590

[58] Field of Search ..... 134/166 R, 182, 183; 239/381, 390, 463, 550, 553, 553.3, 587, 590, 600

[56] References Cited

U.S. PATENT DOCUMENTS

| | | | |
|---|---|---|---|
| 2,548,788 | 4/1951 | Helme | 239/550 X |
| 2,605,140 | 7/1952 | Bartling | 239/550 X |
| 2,621,975 | 12/1952 | Coles | 239/506 |
| 2,723,882 | 11/1955 | Barnett | 239/550 |
| 2,809,073 | 10/1957 | Wahlert | 239/590 |
| 2,860,919 | 11/1958 | De Flon | 239/516 |
| 2,998,934 | 9/1961 | Broughton | 239/550 X |
| 3,038,668 | 6/1962 | Handberg | 239/600 X |
| 3,563,471 | 2/1971 | Watkin | 239/550 X |
| 3,784,101 | 1/1974 | Frempter | 239/553 X |
| 3,860,018 | 1/1975 | Reiter | 134/166 R X |
| 4,240,664 | 12/1980 | Mahyera et al. | 239/550 X |
| 4,294,215 | 10/1981 | Hans et al. | 239/550 X |

FOREIGN PATENT DOCUMENTS

| | | | |
|---|---|---|---|
| 2655060 | 6/1978 | Fed. Rep. of Germany | 239/550 |

*Primary Examiner*—Harvey C. Hornsby
*Assistant Examiner*—Frankie L. Stinson
*Attorney, Agent, or Firm*—Hughes & Cassidy

[57] ABSTRACT

A spray assembly for a milk tank, where there is an elongate water pipe positioned in the tank, and a plurality of spray nozzle assemblies mounted to the pipe. Each spray nozzle assembly comprises a nozzle member having radially inwardly directed openings leading to a middle impact chamber which in turn leads directly to an upper discharge opening. The water flows radially inwardly to the impact chamber to provide a random expanding spray pattern that washes upwardly against the interior surface of the tank. The nozzle member is retained by a member having an expanded head and a shank that extends downwardly through a second opening in the pipe. A releasable retaining member retains the connecting member in place. In operation, the water flows against substantially all of the surface portions of the nozzle assembly to provide a self-cleaning action. The assembly can be easily disassembled for maintenance or possibly further cleaning.

38 Claims, 6 Drawing Figures

MILK TANK CLEANING APPARATUS AND METHOD

BACKGROUND OF THE INVENTION

1. Field of the Invention

The present invention relates to a method and apparatus for cleaning a structure, such as a milk tank, and more particularly, to such a method and apparatus where the apparatus is positioned within the milk tank to spray a cleaning liquid, such as water, upwardly and outwardly against the interior surface of the tank wall.

2. Background Art

In general, the dairy industry has very stringent sanitation requirements. For example, any equipment which comes in contact with the milk must be arranged so that it can be thoroughly cleaned quite regularly. Thus, the milk tanks which carry the milk from the dairy farms to a collecting location must have the interior of the tank washed down at regular intervals.

Another requirement for equipment used in the dairy industry is that the component parts of the equipment must be arranged so that all surfaces of these parts can be thoroughly cleaned, thus avoiding the potential problem of contaminating material being lodged in cracks, crevices, or somewhat inaccessible areas which cannot be easily cleaned. This makes it necessary for the component parts to be easily disassembled for thorough cleaning, or for the components to be "self-cleaning" in that wash water passing through the apparatus performs the cleaning.

The common prior art way of accomplishing the washing of the interior of the milk tank is to place an elongate pipe into the interior of the tank, and to provide this pipe with discharge nozzles at spaced locations along the length of the pipe. One type of nozzle which is commonly used is a "spray ball", which is a spherical member having a plurality of through openings which spray the cleaning liquid (generally water) upwardly and outwardly against the tank interior surface. However, not only are these spray balls quite expensive to manufacture, but the discharge openings can easily be plugged.

Another type of prior art nozzle is one where there is a spiral-like element extending upwardly from an upward opening in the pipe. The water flowing upwardly through the pipe opening is diverted by this spiral-like element to spray outwardly and upwardly against the tank interior. Unfortunately, this nozzle is also expensive to manufacture.

A search of the patent literature has disclosed a number of patents relating generally to spray nozzles or discharge nozzles for a variety of applications. While these are not considered to be directly relevant to the problems toward which the present invention is directed, these are cited below to insure that there is a full disclosure of any prior art of possible relevance.

U.S. Pat. No. 4,339,081, Lindquvist, illustrates a device to be used, for example, as a shower nozzle. There is an insert that fits in a head portion and is retained in the head portion by a screw. The insert is formed with grooves around its outer surface to provide for the flow of water, and the inwardly facing surface of the head portion has similar grooves.

U.S. Pat. No. 3,874,597, Stephens, et al, shows a watering system to be used in various types of agricultural applications. There is a collapsible tube having opposed openings on opposite sides thereof. There is a flow control member having two head portions on its opposite ends, with these two head portions being positioned outside of the flexible tube, and the shank of the flow control member extending through the interior of the tube. Liquid in the tube flows outwardly from the tube and by at least one of the head portions.

U.S. Pat. No. 3,462,085, Nugarus, shows a nozzle where there is a generally cone-shaped deflecting member which discharges the liquid outwardly.

U.S. Pat. No. 2,128,552, Rader et al, also shows a cone-shaped discharge member in a sprinkler head. Such a discharge device is also shown in U.S. Pat. No. 1,510,930, Enell.

U.S. Pat. No. 1,112,622, Jones, shows an irrigating device having a discharge end positioned outside the pipe, and a anchor or retaining member located on the inside surface of the pipe. This is used for subsoil irrigation and is designed to prevent foreign matter from entering into the pipe.

Finally, U.S. Pat. No. 3,188,238, Lyon, is generally representative of a spray system used to clean the interior of a tank.

SUMMARY OF THE INVENTION

The spray assembly of the present invention is particularly adapted to wash an interior of a tank, such as a milk tank. This assembly comprises a pipe and a nozzle assembly that is adapted to be mounted to the pipe.

The pipe has a lengthwise axis and comprises a pipe wall defining a flow passageway. The pipe has first and second through openings formed in the pipe wall, these openings being aligned with each other along an axis of alignment which has a substantial alignment component generally perpendicular to the axis of alignment of the openings.

The nozzle assembly comprises a discharge nozzle adapted to be mounted in an operating position at the first opening. The discharge nozzle has an outlet end to discharge liquid outwardly from the pipe.

There is a locating member having a first connecting end arranged to be engaged to the nozzle, a body portion, and a retaining end adapted to extend outwardly from the pipe to the second opening. There is a retaining member adapted to releasably engage the retaining end of the locating member to retain the locating member in the pipe and thus to maintain the nozzle positioned at the first opening.

When the spray assembly is in its operating position, the discharge nozzle is positioned at the first opening and engaged by the locating member, the retaining member engages the retaining end of the locating member to maintain the nozzle position in the first opening, and liquid flowing in the pipe can be discharged through the nozzle. By releasing the retaining member from engagement with the locating member, the nozzle, locating member and retaining member can be removed from the pipe.

The nozzle comprises a sidewall having an upper end providing the outlet and defining an impact chamber below the outlet. The sidewall extends substantially around the impact chamber, and the sidewall has first opening means arranged to direct streams of water radially inwardly into the impact chamber in a manner that the streams interact in the impact chamber to form an expanding liquid spray that proceeds upwardly and laterally outwardly from the nozzle outlet. Desirably, the first opening means comprises a plurality of openings spaced circumferentially around the sidewall and directed radially inwardly toward the impact chamber.

The preferred embodiment of the nozzle assembly has second opening means positioned below the first opening means and communicating with the flow passageway of the pipe. This causes liquid to flow from the pipe passageway upwardly through the impact chamber to interact with the streams of water passing into the impact chamber from the first opening means. Desirably, the second opening means directs the liquid upwardly along an inwardly facing surface of the nozzle sidewall.

In the preferred embodiment, the nozzle has a lower connecting portion, and the first connecting end of the locating member comprises an expanded head portion adapted to engage the connecting portion of the nozzle. The head member and the connecting portion operatively engage one another in a manner to provide the second opening means. The connecting portion of the nozzle desirably comprises a lower inturned circumferential lip, and the head member engages the lip and has at least portions thereof spaced from the lip to provide said second opening means.

The preferred form of the locating member is such that it comprises an elongate shank connected to the head member and extending through the pipe passageway and through the second opening in the pipe. The retaining end of the shank has opening means to receive the retaining member.

The preferred form of the retaining member is such that it comprises a retaining spring having a pin portion extending through the opening in the retaining end of the locating member and a spring retaining finger to hold the retaining member in place.

The sidewall of the nozzle is desirably formed with an upwardly flared flange portion adapted to engage an outer matching surface of the pipe surrounding the first opening so as to mount the nozzle to the pipe.

In accordance with another feature of the present invention, the pipe has an end opening that is closed by a closure assembly. This closure assembly comprises a closure plate fitting over the end of the pipe, and an overcenter lever mounted by a retaining member to the pipe. The overcenter lever has a closed position where it presses the plate against the pipe.

The plate has a through opening to permit liquid to flow outwardly against the retaining lever so as to provide a cleaning action. Further, the plate fits against the pipe so as to permit liquid to flow between the plate and the pipe. The retaining member for the lever has a generally U-shaped configuration, having a middle portion to engage the lever, and two arms to engage the pipe in retaining relationship.

A preferred configuration of the plate is such that it has an outwardly extending lip portion at an edge portion of the plate. The lip portion is arranged to engage liquid which is discharged through the opening in the plate and deflected by the lever member against the lip portion so as to enhance the cleaning action of the liquid flowing through the opening in the plate.

Other features of the present invention will become apparent from the following detailed description.

DESCRIPTION OF THE PREFERRED EMBODIMENT

The present invention is particularly adapted to be used in cleaning the interior of a milk tank. However, within the broader aspects of the present invention, it is to be understood that the present invention could be used in other applications where there exist problems that are similar to those existing in connection with the cleaning of milk tanks or the like.

Figure 1:
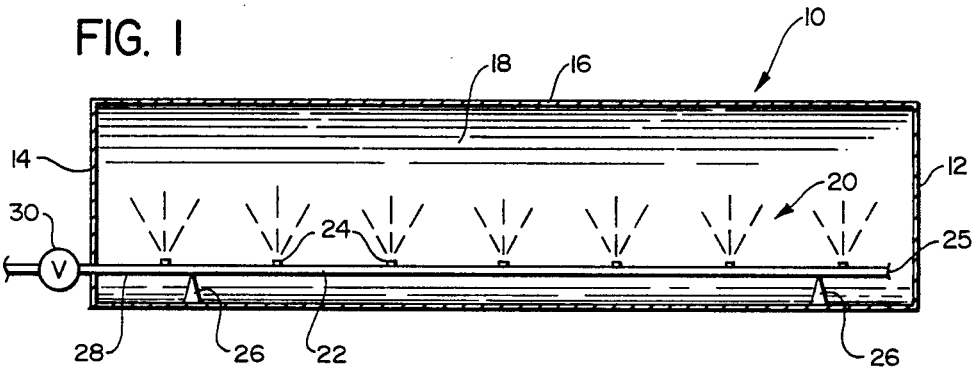
FIG. 1 is a sectional view taken along a vertical plane passing along the length of a milk tank and illustrating the present invention located within the milk tank for cleaning of the same.
Figure 2:
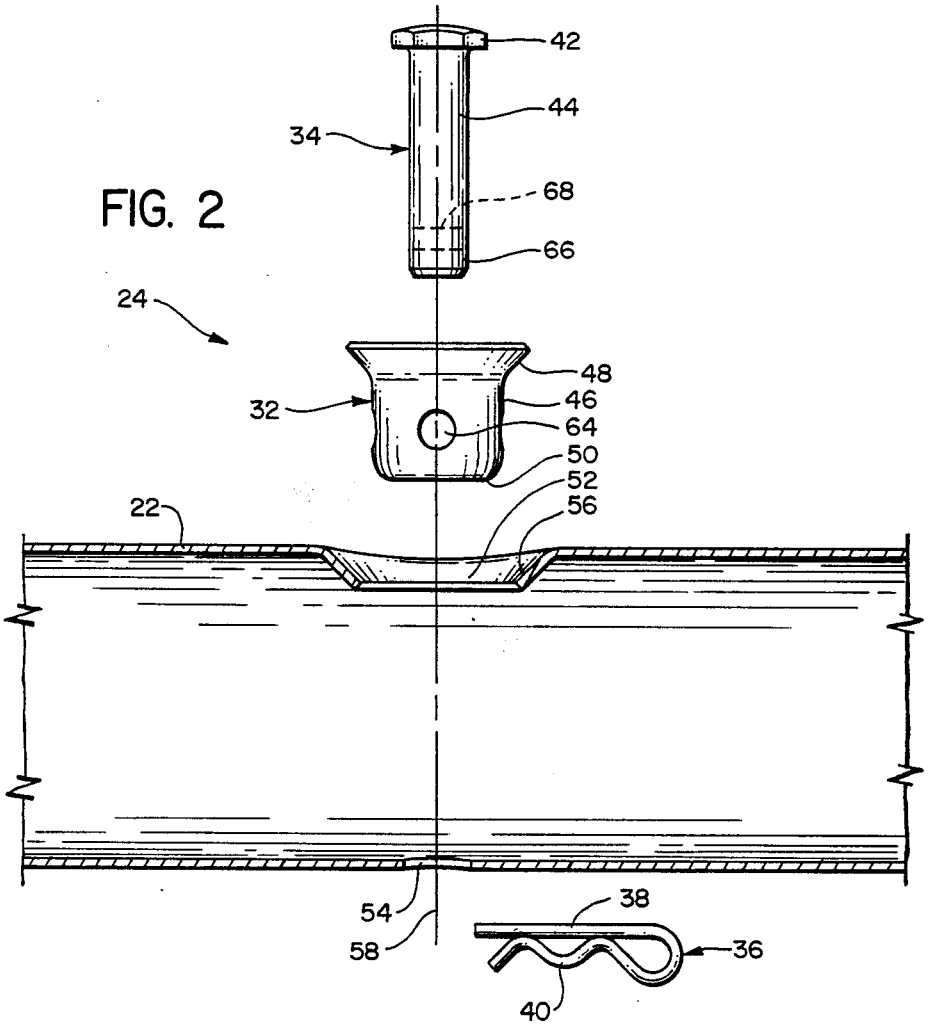
FIG. 2 is an exploded view illustrating the nozzle assembly of the present invention disassembled and arranged to be assembled in its operating position where it is mounted to the water supply pipe.

With reference to FIG. 1, there is shown a milk tank 10 having a front wall 12, a rear wall 14, and a peripheral wall 16 extending entirely around the milk containing chamber 18 provided by the tank 10. The peripheral wall 16 is commonly formed in a generally cylindrical configuration, or possibly in a near cylindrical configuration.

The spray assembly 20 of the present invention is shown in FIG. 1 somewhat schematically in its operating position in the tank chamber 18. This assembly 20 comprises an elongate pipe 22 and a plurality of nozzle assemblies 24, mounted to the pipe 22 and spaced along the length of the pipe 22, and an end cap assembly 25.

Quite commonly, prior art spray assemblies are arranged so that they remain positioned in the tank as a substantially permanent installation, only to be taken out for maintenance or repair. Thus, as the spray assembly is used repeatedly to spray water inside the tank so as to clean the tank's interior, the spray assembly should be self-cleaning. As will be disclosed later herein, the present invention is particularly adapted to be substantially self-cleaning so that it can remain in the tank as a reasonably permanent installation.

The spray assembly 20 extends substantially the entire length of the tank 10, and is positioned adjacent to the lower portion of the peripheral wall 16. The pipe 22 can be supported by suitable support members, some of which are shown schematically at 26. The inlet end 28 of the pipe 22 extends through the rear wall 14 and is provided with a suitable valve 30 which can close the pipe 22 and also provide for a coupling to a source of pressurized water.

Each nozzle assembly 24 of the present invention comprises three components, namely a discharge nozzle member 32, a locating member 34, and a retaining member 36. One of the desirable features of the present invention is that each of these components 32, 34 and 36 are either presently available as common commercial items, or can readily be made from such commercially available items. More specifically, the retaining member 36 is or may be a conventional retaining pin having a pin portion 38 and a spring-like retaining finger 40. The locating member 34 is a commercially available bolt having a hex head 42 and an unthreaded shank 44. The nozzle 32 can be formed from a piece of cylindrical metal pipe stock, as will be described below.

To describe the nozzle 32 more specifically, this nozzle 32 has a generally cylindrical configuration, and comprises a cylindrical middle body portion 46, an upper outwardly flared discharge end 48, and a lower inwardly swayed connecting end 50. To mount the nozzle assemblies 24, the pipe 22 is formed at each mounting location with upper and lower diametrically opposed openings 52 and 54. The structure surrounding the upper opening 52 is formed by pressing the material surrounding the opening 52 downwardly toward the interior of the pipe 22 so as to form a downwardly and inwardly flared seat or flange 56 of a frusto-conical configuration. The diameter of the opening 52 is moderately larger than the diameter of the outside surface of the body portion 46 of the nozzle 32. The lower opening 54 is moderately larger than the diameter of the shank 44 of the bolt or locating member 34.

The discharge end 48 of the nozzle 32 is flared outwardly and upwardly at an angle of about 45° with respect to the longitudinal center axis 58 of the nozzle 32. This flared nozzle end portion 48 is approximately of the same configuration as the flange or seat 56 formed around the upper pipe opening 52, so that the nozzle 32 can be mounted in the opening 52 by the flared end 48 fitting against the seat 56.

Figure 4:
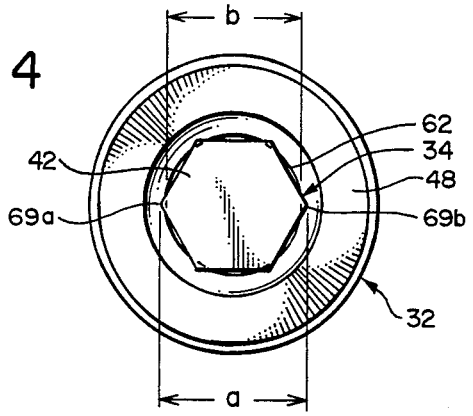
FIG. 4 is a top plan view looking down on the nozzle assembly of FIG. 3.

The lower connecting end 50 of the nozzle 32 is formed as a downwardly and radially inwardly curving circumferential lip 60, defining a through opening 62 having a diameter moderately smaller than the diameter of the hex head 42, as measured from point 69*a* to point 69*b* (indicated at "a" in FIG. 4). The cylindrical body portion 46 of the nozzle 32 is formed with a plurality of circumferentially spaced discharge openings 64. In the particular embodiment shown herein, there are four such openings 64, evenly spaced from one another 90° apart around the circumference of the body portion 46, at about the midheight of the body portion 46. The body portion 46 defines an impact chamber 65 into which water flows from the holes 64, with the streams of water impacting each other to form the random spray pattern that proceeds upwardly from the nozzle 32.

When the nozzle assembly 24 is placed in its operating position, the nozzle member 32 is positioned in the upper pipe opening 52 so that the upper flared end 48 of the nozzle 32 rests on the flange or seat 56 surrounding the opening 52. The locating member on bolt 34 is then inserted downwardly through the nozzle 32 so that the shank 44 extends through the bottom opening 62 defined by the lip 60 of the nozzle 32, with the lower end portion 66 protruding downwardly through the bottom pipe opening 54 so as to extend beyond the lower side of the pipe 22. The lower end 66 of the shank 44 is formed with a through opening 68 just below the lower surface of the pipe 22, and the retaining pin portion 38 of the retaininer 36 is inserted through the opening 68 in the shank 66 so as to hold the bolt 34 in the position shown in FIG. 3.

In a typical spray assembly, the maximum diameter of the bolt head 42 (indicated at "a") would be about 15/32 inch. The diameter of the lower opening 62 of the nozzle member 32 (indicated at "b") would be between 13/32 inch and 14/32 inch. The outside diameter of the body portion 46 of the nozzle member 32 (indicated at "c") is about 17/32 inch, while the inside diameter of the upper opening 52 in the pipe 22 (indicated at "d") is about 11/16 inch.

The diameter of the shank 44 is about 3/16 inch, while the diameter of the lower opening 54 is about ¼ inch. Finally, the outside diameter of the outwardly flared discharge end 48 (indicated at "e") is about 13/16 inch.

Figure 3:
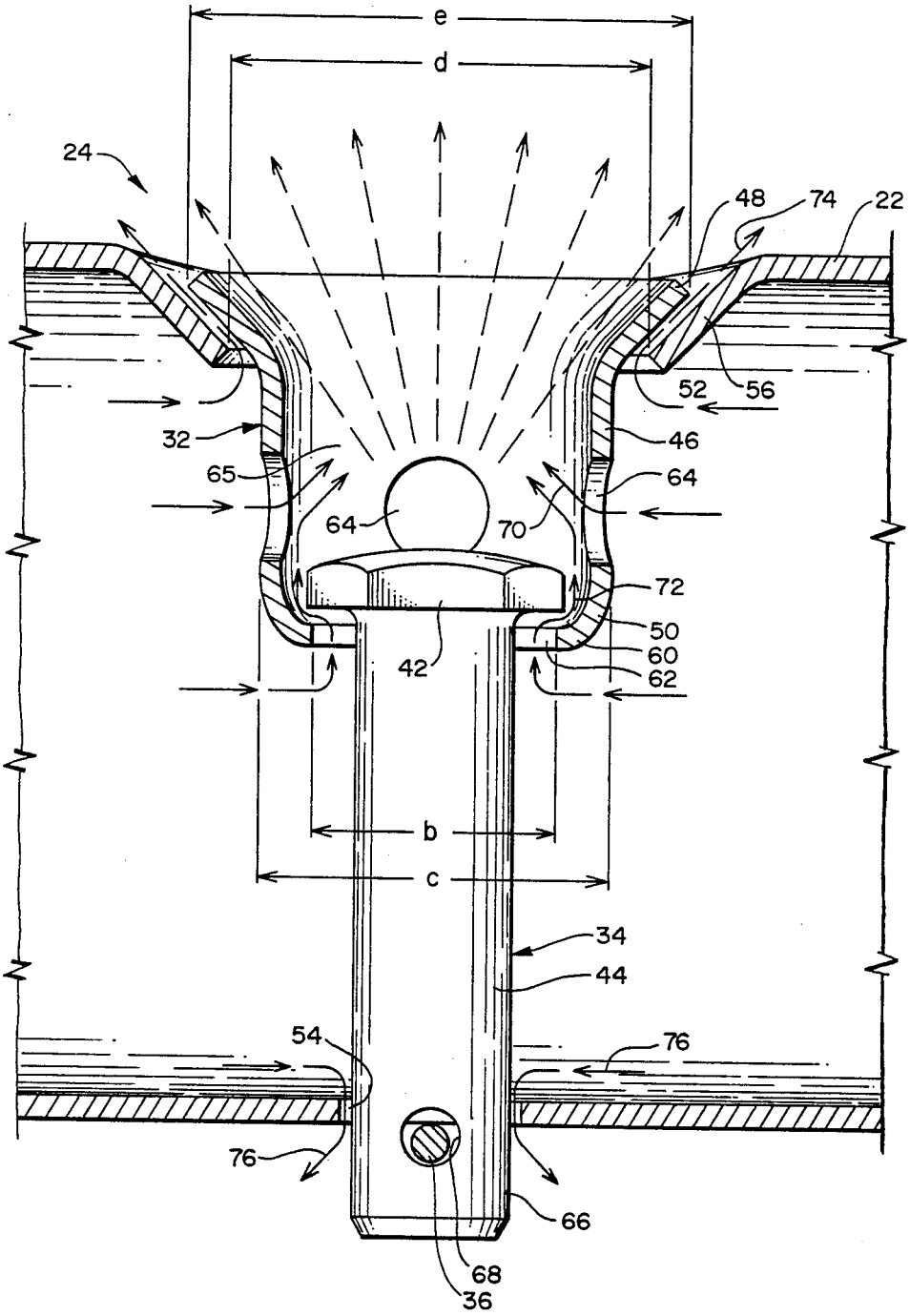
FIG. 3 is a sectional view taken through the centerline of the nozzle assembly of the present invention, with the nozzle assembly being in its operating position.

To describe the operation of the nozzle assemblies 24 of the present invention, let it be assumed that the pipe 22, with the nozzle assemblies 24 mounted thereto, as shown in FIGS. 3 and 4, is in position within the tank 10, as illustrated in FIG. 1. This entire spray assembly 20 (comprising the pipe 22 and the nozzle assemblies 24) can remain in the tank chamber 18 indefinitely. After the milk is discharged from the tank 10, the tank interior can be washed down by attaching the coupling of the valve 30 to a source of pressurized water..

As the water flows into the pipe 22 so as to pressurize the flow passage defined by the pipe 22, this water immediately begins to pass outwardly through the nozzle assemblies 24. First, there is a flow of four jets of water (indicated at 70) inwardly through the four circumferentially spaced discharge openings 64 and into the impact chamber 65 defined by the nozzle 32. Also, there is a flow of water upwardly through the bottom nozzle opening 62 and around the flat sides 72 of the hex head 42 and thence upwardly along the inside surface of the body portion 46 (this flow being indicated at 72 in FIG. 3). Also, there is flow through the annular opening defined by the flared end 48 of the nozzle member 32 and the flange or seat 56 formed in the pipe 22. This flow of water is upwardly and radially outwardly in a cone-shaped spray pattern, as indicated at 74. Further, since there is a certain amount of clearance between the outer surface of the shank 44 and the lower pipe opening 54, there will be a certain flow of water downwardly through this opening 54 (indicated at 76). (This downward flow of water has less to do with the overall function of cleaning the tank, but is significant in that this is a self-cleaning feature of the valve assembly 24.)

It has been found that the discharge of the cleaning water from the valve assembly 24 results in a spray that travels upwardly outwardly in an expanding cone-shaped pattern, where the angle between the geometric limits of the sidewalls of the cone is approximately 90° or possibly greater. To express this in different terms, the lateral portions of the spray travel upwardly and outwardly at about a 45° angle from a vertical axis.

It has been found that the impingement of the four radially inward streams 70 react in a random pattern so that the spray covers the entire area within the spray cone area with droplets in a random manner. Further, the upward flow of water at 72 adds to this overall random spray effect to insure that the cleaning liquid impinges upon all portions of the tank.wall that is within the area of the spray cone. The water spraying on the upper portion of the tank wall 16 then flows downwardly along the wall to complete the cleaning action.

An examination of the flow patterns discussed above makes it readily apparent that all surface portions of the components in the spray assembly 20 are sufficiently exposed to the flow of water so that the outflow of water through the nozzle assemblies 24 accomplishes the self-cleaning action.

With regard to the placement of the discharge openings 64, if these openings 64 are placed too deeply in the body portion 46 of the nozzle member 32, then the outflow of water in an upward direction is more of a straight column of water, rather than a diverging cone. On the other hand, if these openings 64 are placed at too high of a location within the body portion 46, then the spray is directed too much in a lateral pattern, and not enough of the spray is upwardly against the top of the tank wall 16. It has been found that if the diameter of the discharge openings 64 are made to be about ⅛ inch diameter, and if the center of these openings 64 are located at about ⅜ inch below the upper edge of the flared end 48, there is a proper discharge pattern of the cleaning water.

Figure 5:
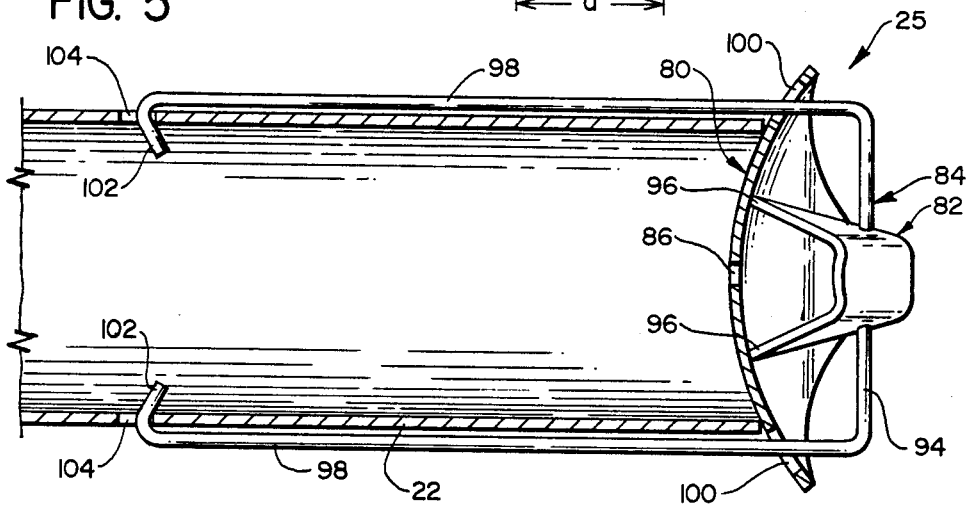
FIG. 5 is a bottom view, partly in section, illustrating an end cap used to close the end of the distribution pipe.
Figure 6:
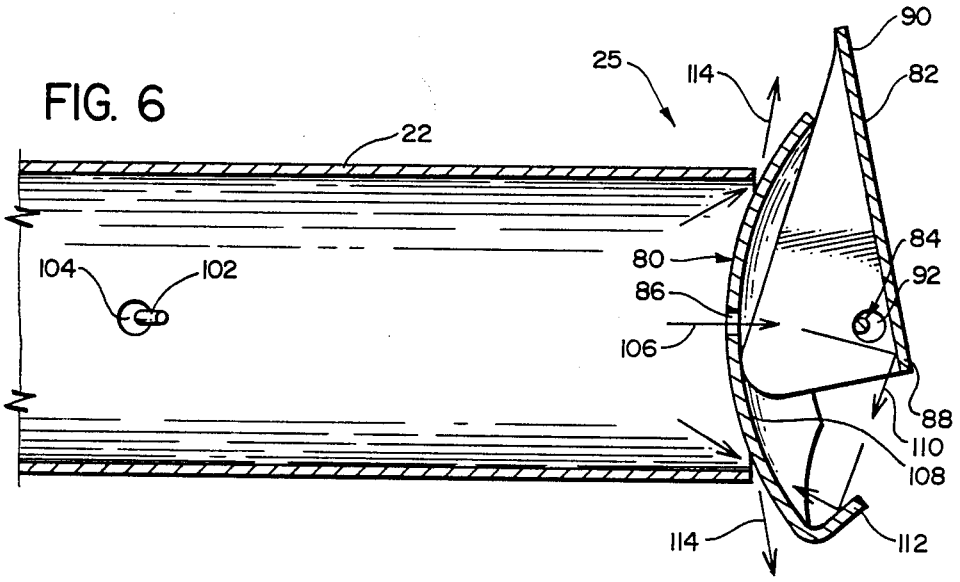
FIG. 6 is a side view, partly in section, illustrating the end cap of FIG. 5.

A second feature of the present invention will now be described with reference to FIGS. 5 and 6. The end of the pipe 22 that is opposite to the inlet end 28 needs to be closed in some manner to maintain adequate pressure within the pipe 22. However, it is desirable that this end of the pipe not be a total "dead end" which would be detrimental to the self-cleaning feature of the assembly 20. Accordingly, the end closure assembly 25 of the present invention is provided. In general, this closure assembly 25 comprises a curved end closure plate 80 which is held in place by an over center locking lever 82, which in turn is held in place by a U-shaped retaining member 84.

The plate 80 is made moderately concave so that it curves inwardly toward the interior of the pipe 22. This plate 80 has a center through opening 86 through which water can flow outwardly in a direction parallel to the axial centerline of the pipe 22. This water flowing through the opening 86 contributes to the self-cleaning action of this end closure assembly 25.

The locking lever 82 has a pivot end 88 and a manipulating end 90. The pivot end 88 is formed with a through opening 92 to receive a crossmember 94 of the retaining member 84. Further, this locking member 82 has in cross-section a generally U-shaped configuration and has near its pivot location 92 a pair of laterally spaced bearing members 96 spaced from the openings 92. These bearing surfaces 96 are arranged so that when the locking member 88 is in its locking position, as shown in FIGS. 5 and 6, the two bearing surfaces are in an overcenter position relative to the location of the pivot axis, which is coincident with the lengthwise axis of the crossmember 94 of the retaining member 84. The retaining member 84, in addition to comprising the crossmember 94, has a pair of arms 98 that extend through openings 100 in the closure plate 80 and terminate in two fingers 102, which in turn fit in openings 104 formed in the pipe 22.

To assemble the closure assembly 25, the locking lever 82 is held in a direction generally perpendicular to the plate 80, and then the plate is brought to a position adjacent to the open end of the pipe 22. The two retaining fingers 102 are inserted through the holes 104, after which the lever 82 can be rotated through approximately 90° to move the bearing surfaces 96 through their overcenter position to the locking position of FIGS. 5 and 6.

With the closure assembly 25 thus held in place, this closure assembly 25 can remain in this position indefinitely because of the self-cleaning action of the water flowing therethrough. More specifically, the water can flow through the central opening 86 so that it impinges against the surface of the lever 82 (this stream of water indicated at 106). The water which impinges on the lever 82 is deflected back toward the surface 108 of the plate 80. Further, soxe of this water (indicated at 110) impinges against an inturned lip 112 which extends outwardly from a perimeter portion of the plate 80. This causes some of the water to be deflected back against the surface 108 and also against the lip 112. Further, since the plate 80 does not have a watertight fit against the edge of the pipe 22, there is a certain flow of water (indicated at 114) outwardly through the small gap between the plate 82 and the pipe 22.

We claim:

1. A spray assembly adapted to wash an interior of a tank, such as a milk tank, said assembly comprising:

a. a pipe which is adapted to be positioned in said tank, said pipe having a lengthwise axis and comprising a pipe wall defining a flow passageway, said pipe having first and second through apertures formed in the pipe wall, said apertures being aligned with each other along an axis of alignment which has a substantial alignment component generally perpendicular to the lengthwise axis of the pipe;

b. a nozzle assembly comprising:

1.a discharge nozzle adapted to be mounted in an operating position at said first aperture, said discharge nozzle comprising a side wall having an upper circumferential edge defining a substantially unobstructed upper outlet, said sidewall defining and extending substantially around an impact chamber positioned below the outlet and immediately adjacent thereto, said sidewall having first opening means arranged to direct streams of water radially inwardly into said impact chamber, said first opening means being positioned below the upper circumferential edge of the side wall at a predetermined location so that said streams interact in the impact chamber to form an expanding liquid spray that proceeds directly from the impact chamber upwardly and laterally outwardly from the outlet in an expanding spray pattern;

2.a locating member having a first connecting end arranged to be engaged to said nozzle, a body portion, and a retaining end adapted to extend to said second aperture;

3.a retaining member adapted to releasably engage the retaining end of the locating member to retain the locating member in the pipe and thus maintain the nozzle positioned at the first aperture;

whereby, when the spray assembly is in its operating position, the discharge nozzle is positioned at the first aperture and engaged by the locating member, the retaining member engaging the retaining end of the locating member to maintain the nozzle positioned in the first aperture, and liquid flowing in said pipe can be discharged through said nozzle, and by releasing the retaining member from engagement with the locating member, the nozzle, locating member and retaining member can be removed from the pipe.

2. The spray assembly as recited in claim 1, wherein said first opening means comprises a plurality of openings spaced circumferentially around said side wall and directed radially inwardly toward said impact chamber.

3. The spray assembly as recited in claim 2, wherein said nozzle assembly has second opening means positioned below said first opening means and communicating with the flow passageway of the pipe to cause liquid to flow from the pipe passageway upwardly through said impact chamber to interact with the streams of water passing into the impact chamber from the first opening means.

4. The spray assembly as recited in claim 3, wherein said second opening means directs liquid upwardly along an inwardly facing surface of said nozzle sidewall.

5. The spray assembly as recited in claim 1, wherein said nozzle assembly has second opening means positioned below said first opening means and communicating with the flow passageway of the pipe to cause liquid to flow from the pipe passageway upwardly through said impact chamber to interact with the streams of water passing into the impact chamber from the first opening means.

6. The spray assembly as recited in claim 5, wherein said first opening means comprises a plurality of openings spaced circumferentially around said side wall and directed radially inwardly toward said impact chamber.

7. The spray assembly as recited in claim 5, wherein said nozzle has a lower connecting portion, and the first connecting end of the locating member comprises an expanded head portion adapted to engage the connecting portion of the nozzle, said head member and said connecting portion operatively engaging one another in a manner to provide said second opening means.

8. The spray assembly as recited in claim 7, wherein the connecting portion of the nozzle comprises a lower inturned circumferential lip, and said head member engages said lip and has at least portions thereof spaced from said lip to provide said second opening means.

9. The spray assembly as recited in claim 8, wherein said locating member comprises an elongate shank connected to said head member and extending through said pipe passageway and through said second aperture in the pipe, the retaining end of the shank having retaining opening means adapted to receive said retaining member.

10. The spray assembly as recited in claim 9, wherein said retaining member comprises a retaining spring having a pin portion extending through said retaining opening means in the retaining end of the locating member and a spring retaining finger to hold said retaining member in place.

11. The spray assembly as recited in claim 1, wherein said discharge nozzle has a generally cylindrical configuration, and said sidewall has an upper outwardly flared flange portion adapted to engage an outer matching surface of said pipe surrounding said first aperture so as to mount said nozzle to said pipe, said sidewall of the nozzle having a lower inturned circumferential lip, the connecting end of the locating member comprising an expanded head portion adapted to engage said lower lip of the nozzle so as to maintain the nozzle positioned at said first opening, said lip and said head portion having at least portions thereof spaced from one another in a manner to define second opening means which is positioned below said first opening means, with flow of liquid from the pipe passageway upwardly through the second opening means interacting with the streams of water directed radially inwardly into the impact chamber.

12. The spray assembly as recited in claim 1, wherein said pipe has an inlet end adapted to receive a pressurized liquid, and an open outlet end, said spray assembly further comprising a closure assembly comprising a closure plate fitting over the end of the pipe, an overcenter lever mounted by a retaining member to said pipe, said overcenter lever having a closed position where it presses the plate against the pipe, said plate having a through opening to permit liquid to flow outwardly against said retaining lever so as to provide a cleaning action.

13. The spray assembly as recited in claim 12, wherein said plate fits against said pipe so as to permit liquid to flow between said plate and said pipe, and the retaining member for the lever has a generally U-shaped configuration, having a middle portion to engage said lever, and two arms to engage said pipe in retaining relationship.

14. The spray assembly as recited in claim 13, wherein said plate has an outwardly extending lip portion at an edge portion of said plate, said lip portion being arranged to engage liquid which is discharged through the opening in the plate and deflected by the lever member against the lip portion so as to enhance cleaning action of the liquid flowing through the opening in the plate.

15. The assembly as recited in claim 1, wherein the upper circumferential edge of the sidewall fits within said first aperture in a manner that liquid flowing through said pipe is able to pass outside of said sidewall and through said first aperture so as to perform a cleaning function between said side wall and said first aperture.

16. The assembly as recited in claim 15, wherein said retaining end of the locating member extends through said second aperture with a clearance sufficient to permit liquid flowing in said pipe to pass around said locating member and through said second aperture so as to perform a cleaning function between said locating member and said second aperture.

17. The assembly as recited in claim 1, wherein said retaining end of the locating member extends through said second aperture with a clearance sufficient to permit liquid flowing in said pipe to pass around said locating member and through said second aperture so as to perform a cleaning function between said locating member and said second aperture.

18. A self-cleaning spray nozzle assembly adapted to be mounted to a liquid supply pipe having a lengthwise axis and defining a flow passageway, and to discharge liquid in an expanding spray pattern, where said pipe has first and second side openings in a wall of said pipe, said openings being aligned with each other along an axis of alignment which has a substantial alignment component generally perpendicular to the lengthwise axis of the pipe, said nozzle assembly comprising:

a. a discharge nozzle adapted to be mounted in an operating position at said first opening, said discharge nozzle having an outlet to discharge liquid outwardly from the pipe, said nozzle comprising a sidewall having an upper end providing said outlet and defining an impact chamber, with the sidewall extending substantially around said impact chamber below the outlet, said sidewall having first opening means arranged to direct streams of water radially inwardly into said impact chamber in a manner that said streams interact in the impact chamber to form an expanding liquid spray that proceeds upwardly and laterally outwardly from the nozzle outlet;

b. a locating member having a first connecting end arranged to be engaged to said nozzle, a body portion, and a retaining end adapted to extend in said pipe to said second opening;

c. a retaining member adapted to releasably engage the retaining end of the locating member to retain the locating member in the pipe and thus maintain the nozzle positioned at the first opening;

whereby, when the spray assembly is in its operating position, the discharge nozzle is positioned at the first opening and engaged by the locating member, the retaining member engaging the retaining end of the locating member to maintain the nozzle positioned in the first opening, and liquid flowing in said pipe can be discharged through said nozzle, and by releasing the retaining member from engagement with the locating member, the nozzle, locating member and retaining member can be removed from the pipe.

19. The spray assembly as recited in claim 18, wherein said first opening means comprises a plurality of openings spaced circumferentially around said side wall and directed radially inwardly toward said impact chamber.

20. The spray assembly as recited in claim 19, wherein said nozzle assembly has second opening means positioned below said first opening means and communicating with the flow passageway of the pipe to cause liquid to flow from the pipe passageway upwardly through said impact chamber to interact with the streams of water passing into the impact chamber from the first opening means.

21. The spray assembly as recited in claim 20, wherein said second opening means directs liquid upwardly along an inwardly facing surface of said nozzle sidewall.

22. The spray assembly as recited in claim 18, wherein said nozzle assembly has second opening means positioned below said first opening means and communicating with the flow passageway of the pipe to cause liquid to flow from the pipe passageway upwardly through said impact chamber to interact with the streams of water passing into the impact chamber from the first opening means.

23. The spray assembly as recited in claim 22, wherein said nozzle has a lower connecting portion, and the first connecting end of the locating member comprises an expanded head portion adapted to engage the connecting portion of the nozzle, said head member and said connecting portion operatively engaging one another in a manner to provide said second opening means.

24. The spray assembly as recited in claim 23, wherein the connecting portion of the nozzle comprises a lower inturned circumferential lip, and said head member engages said lip and has at least portions thereof spaced from said lip to provide said second opening means.

25. The spray assembly as recited in claim 24, wherein said locating member comprises an elongate shank connected to said head member and extending through said flow passageway and through said second opening in the pipe, the retaining end of the shank having opening means adapted to receive said retaining member.

26. The spray assembly as recited in claim 25, wherein said retaining member comprises a retaining spring having a pin portion extending through said opening in the retaining end of the locating member and a spring retaining finger to hold said retaining member in place.

27. The spray assembly as recited in claim 18, wherein said discharge nozzle has a generaliy cylindrical configuration, and said sidewall has an upper outwardly flared flange portion adapted to engage an outer matching surface of said pipe surrounding said first opening so as to mount said nozzle to said pipe, said sidewall of the nozzle having a lower inturned circumferential lip portion, the connecting end of the locating member comprising an expanded head portion adapted to engage said lower lip of the nozzle so as to maintain the nozzle positioned at said first opening, said lip and said head portion having at least portions thereof spaced from one another in a manner to define second opening means which is positioned below said first opening means, with flow of liquid from the pipe passageway upwardly through the second opening means interacting with the streams of water directed radially inwardly into the impact chamber.

28. A self-cleaning spray nozzle assembly adapted to be mounted to a liquid supply pipe having a lengthwise axis and defining a flow passageway, and to discharge liquid in an expanding spray pattern, where said pipe has first and second side openings in a wall of said pipe, said openings being aligned with each other along an axis of alignment which has a substantial alignment component generally perpendicular to the lengthwise axis of the alignment opening, said nozzle assembly comprising:

a. a discharge nozzle adapted to be mounted in an operating position at said first opening, said discharge nozzle having a generally cylindrical configuration, comprising an upwardly and outwardly flared end adapted to engage said pipe at said first opening, a lower inturned lip portion, and a main generally cylindrical body portion defining a middle impact chamber, said body portion having a plurality of radially extending through openings adapted to receive liquid from said pipe and direct said liquid in streams radially inwardly into said impact chamber;

b. a locating member comprising an expanded head portion adapted to be positioned in said nozzle and engage said lower lip portion of the nozzle, a shank portion extending through a lower opening in said nozzle and outwardly through the second opening in the pipe;

c. a releasable retaining member adapted to engage the shank at a location adjacent said pipe so as to retain the locating member in the pipe and thus maintain the nozzle positioned at the first opening;

d. said nozzle, said locating member and said retaining member being arranged relative to each other so that liquid in the pipe is able to flow between said locating member and said nozzle, as well as around said nozzle, and also around said shank and against said retaining member, so as to provide a self-cleaning action when liquid is flowing in said pipe and outwardly through said nozzle assembly.

29. The nozzle assembly as recited in claim 28, wherein said nozzle assembly is provided with second openings for flow of liquid therethrough at a location below the openings in the body portion of the nozzle, said second openings being arranged to discharge liquid from the pipe upwardly into said impact chamber.

30. The nozzle assembly as recited in claim 29, wherein said head portion and said lip of the nozzle are arranged to interengage one another in a manner to define said second openings for flow of liquid upwardly into said impact chamber.

31. The nozzle assembly as recited in claim 30, wherein said retaining member comprises a retaining spring having a pin portion extending through said opening in the retaining end of the locating member and a spring retaining finger to hold said retaining member in place.

32. A self-cleaning closure assembly particularly adapted to be used to close a supply pipe of a spray cleaning system, said closure assembly comprising:

a. a closure plate adapted to fit over an end of the pipe in a blocking position so as to substantially prevent flow from the end of the pipe;

b. an overcenter lever having a release position and an overcenter locking position where it securely holds the plate against the pipe and does not permit the plate to move from said blocking position;

c. a retaining member to which said overcenter lever is mounted, said retaining member having a pair of arms connecting to said pipe;

d. said plate having a through opening to permit limited liquid flow outwardly against said retaining lever so as to provide a cleaning action while the plate substantially blocks flow from the end of the pipe.

33. The closure assembly as recited in claim 32, wherein said plate fits against said pipe so as to permit liquid to flow between said plate and said pipe, and the retaining member for the lever has a generally U-shaped configuration, having a middle portion to engage said lever, and two arms to engage said pipe in retaining relationship.

34. The closure assembly as recited in claim 33, wherein said plate has an outwardly extending lip portion at an edge portion of said plate, said lip portion being arranged to engage liquid which is discharged through the opening in the plate and deflected by the lever member against the lip portion so as to enhance cleaning action of the liquid flowing through the opening in the plate.

35. A spray adapted to wash an interior of a tank, such as a milk tank, said assembly comprising;

a. a pipe which is adapted to be positioned in said tank, said pipe having a lengthwise axis and comprising a pipe wall defining a flow passageway, said pipe having a through aperture formed in the pipe sidewall; and b. a discharge nozzle adapted to be mounted in an operating position at said aperture, said discharge nozzle comprising a side wall having an upper circumferential edge defining a substantially unobstructed upper outlet, said sidewall defining and extending substantially around an impact chamber positioned below the outlet and immediately adjacent thereto, said sidewall having opening means arranged to direct streams of water radially inwardly into said impact chamber, said means being positioned below the upper circumferential edge of the side wall at a predetermined location so that said streams interact in the impact chamber to form an expanding liquid spray that proceeds directly from the impact chamber upwardly and laterally outwardly from the outlet in an expanding spray pattern.

36. The spray assembly as recited in claim 35, wherein said first opening means comprises a plurality of openings spaced circumferentially around said sidewall and directed radially inwardly toward said impact chamber.

37. The spray assembly as recited in claim 36, wherein said nozzle has second opening means positioned below said first opening means and communicating with the flow passageway of the pipe to cause liquid to flow from the pipe passageway upwardly through said impact chamber to interact with the streams of water passing into the impact chamber from the first opening means.

38. The spray assembly as recited in claim 37, wherein said second opening means directs liquid upwardly along an inwardly facing surface of said nozzle sidewall.

* * * * *